United States Patent [19]

Wyatt et al.

[11] Patent Number: 4,644,967

[45] Date of Patent: Feb. 24, 1987

[54] FLUID FLOW CONTROL SYSTEM

[75] Inventors: W. Gerald Wyatt, Arlington; Richard Redus, Dallas, both of Tex.

[73] Assignee: Vapor Energy Corp., Arlington, Tex.

[21] Appl. No.: 759,665

[22] Filed: Jul. 29, 1985

Related U.S. Application Data

[63] Continuation-in-part of Ser. No. 554,780, Nov. 25, 1983, abandoned.

[51] Int. Cl.[4] ..... F17D 3/00

[52] U.S. Cl. ..... 137/599; 60/39.3

[58] Field of Search ..... 137/512.1, 599, 625.28; 60/39.53, 39.55, 39.3

[56] References Cited

U.S. PATENT DOCUMENTS

| | | | |
|---|---|---|---|
| 2,999,482 | 4/1961 | Bower | 137/599 |
| 3,905,394 | 9/1975 | Jerde | 137/599 |
| 4,288,978 | 9/1981 | Wyatt | 60/39.55 |
| 4,313,465 | 2/1982 | Holzem | 137/599 |

*Primary Examiner*—Louis J. Casaregola

*Attorney, Agent, or Firm*—Stanley R. Moore; Thomas L. Cantrell

[57] ABSTRACT

Disclosed is a dual output, pressure responsive, adjustable, fluid flow control system. It includes first and second flow networks coupled in parallel flow communication, the networks each have first and second flow paths, and the first flow path of flow networks has an adjustable flow control valve for regulating the flow therethrough. Similarly, the second flow path of said networks has a pressure responsive valve disposed therein for maintaining substantially constant flow therethrough with variations in fluid flow pressure therein. Also included are feed means for supplying fluid to said flow networks, and means for receiving fluid from said fluid flow networks, as well as means for engaging and disengaging the second flow network to said fluid supply means for selectively permitting the flow therethrough and facilitating a dual flow output from the system.

9 Claims, 3 Drawing Figures

FLUID FLOW CONTROL SYSTEM

This application is a continuation-in-part of Ser. No. 554,780, filed Nov. 25, 1983 (abandoned).

BACKGROUND OF THE INVENTION

1. Field of the Invention

The present invention relates to vapor generators and, more particularly, to a vapor generator fluid flow control system, permitting controlled fuel, air and water flow and pressure regulation.

2. History of the Prior Art

Vapor generators of the kind in which a fuel-air mixture is combusted in the direct presence of feed water to produce a useful mixture of steam and non-condensibles are known. Such vapor generators are shown in U.S. Pat. No. 4,211,071 issued to the assignee of the present invention. In accordance with that invention, a vapor generator is provided in which several interrelated means are employed to improve the quality of combustion in the generator so that a product steam substantially free of carbon monoxide results. In effecting this result, means are provided for dividing the air feed into two parts which are both delivered to the generator for combustion. Such methods and apparatus are effective in producing a well-mixed stoichiometric mixture of fuel and air to provide completeness of combustion and reducing production of carbon monoxide to extremely low levels. Such an accomplishment is a marked advance over the prior art and illustrates the emphasis placed on controlled flow rates and mixture conditions.

The prior art is also replete with apparatus manifesting high temperature product vapor having high carbon monoxide content. Such conditions are objectionable for many applications and dangerous for some of them. High carbon monoxide production is traceable to incomplete combustion. This is, in turn, traceable in part to difficulties in maintaining a stable lean flame and, in part, to excessive quenching of the flame through direct radiation and convective contact between the flame and the feed water. Once a stoichiometric mixture is obtained, it is, therefore, necessary to maintain the combustion level without varying any of the three major constituents of fuel, air, or water. Variations would affect the combustion and the carbon monoxide production therefrom.

Other problems occur in certain ones of the prior art vapor generators when they are operated at low pressures. Conventionally, as shown in U.S. Pat. No. 4,288,978, a vapor generator may be especially adapted for low pressure operation by the provision of certain features such as a pilot burner for striking a stable flame. It may be seen that low pressure operation, likewise, requires a specific reduction in the air, fuel and water input for a low volume output from the vapor generator. Disproportionate variances in any of the three constituents will seriously affect the combustion level and the resulting heat and vapor content of the downstream product.

Few prior art systems effectively address dual output vapor generator operation. The ability to fine tune the fuel, air and water flow for a single vapor generator output is critical enough. Once this critical equilibrium is reached, it is tantamount to starting over to vary the generator operation to another flow. Varying the generator volume necessitates adjustment in the air, fuel and water flow rates which will directly affect both the heat and the water vapor level of the combustion products. When such generators are used in industrial applications necessitating precise control of heat and vapor, these variations are not tolerable. One such application is the curing of concrete where the temperature and moisture level of the vapor products have a direct effect on the curing process and resulting structural condition of the cast product.

The use of steam for concrete curing is not novel in and of itself. Steam has been produced from conventional boilers for such methods and processes, but the cost of a boiler operation is much higher than that of a vapor generator type device. Moreover, the temperature and vapor level of the steam product can be more closely controlled than with a conventional boiler. Moreover, super heated vapor can be provided for specific types of aggregate to be cured. The flexibility of the vapor generator also permits substantially instantaneous operation as compared to the threshold period for a boiler method. The obvious disadvantage is the substantially single flow rate afforded by most conventional vapor generators. Since any number of kilns may be run at one time for particular production schedules, excess vapor from a single flow rate vapor generator system would, thereby, be wasted.

Conventional techniques for varying the output of standard vapor generators includes reducing the rate of combustion and water flow while maintaining a constant air flow rate. The advantage of such a system is simplicity and cost in that reliable variations in air flow rates have been, to date, difficult to attain. The paramount disadvantage to the continuous air flow volume is the excess air ingressing into the kiln and the adverse effects to the curing process which affects the ultimate humidity level within the kiln and imparts non-uniform cooling characteristics. Variations in the air flow volume have, to date, been addressed by multiple speed blowers and throttle systems which either decrease the air intake to the blower or exhaust therefrom. Unfortunately, the relatively large motors and blower units necessary for vapor generator volumes generate large amounts of heat which the air volume dissipates. When the air volume is throttled for constant motor speed, heat dissipation is inhibited and variations in flow rate result as well as having degenerative effects on the motor and the blower unit. The obvious alternative to such flow problems is a multiple speed motor, but the cost and availability for such systems are generally disproportionate to the vapor generator construction.

Dual output vapor generator applications also require dual flow feedwater systems which may be accurately set in preselected flow configurations as well as precisely maintained. Precise fluid flow is an integral element of the aforesaid combustion efficiency particularly in stoichiometric mixtures. The primary area of fluid flow consideration in such vapor generator systems is in the water flow controlling network. Prior art flow control devices though capable of preselect flow volumes are generally not sensitive to variations in flow pressure which affects the flow volume.

It would be an advantage therefore to overcome the problems of the prior art by providing a variable output vapor generator having a constant volume fluid flow system which affords automatic operation between high and low fluid flow rates and which is sensitive to fluctuations in fluid flow pressure. One approach to dual output vapor generators and a discussion of prior art problems associated therewith is discussed in co-pending U.S. patent application Ser. No. 554,780 assigned to the assignee of the present invention. The method and apparatus of the present invention comprises an advanced system overcoming the problems set forth above by providing a combination of a pressure responsive valve and fine adjustment valve in parallel flow communication. This parallel flow system is itself aligned in parallel flow communication with a second matching system adapted for selective actuation for high and low volume operation. In this manner both the high volume and low volume flow rates within the water flow system of a vapor generator may be preadjusted for automatic actuation as needed by demand conditions. This has been done in a configuration facilitating automatic temperature control and which is pressure sensitive for accurate volumetric control without adversely affecting the efficiency of the generator system.

SUMMARY OF THE INVENTION

The present invention pertains to vapor generators incorporating a dual fluid flow control actuation system which is pressure responsive in conjunction with minor flow adjustability. In one aspect, the present invention includes a dual output, pressure responsive, adjustable, fluid flow control system which comprises first and second flow networks coupled in parallel flow communication. The first and second flow networks each comprise first and second flow paths which comprise an adjustable flow control valve for regulating the flow therethrough. The second flow path of the networks comprises a pressure responsive valve disposed therein for maintaining substantially constant flow therethrough with variations in fluid flow pressure. There is also shown means for supplying water to and means for receiving water from the fluid flow networks and means for engaging and disengaging the second flow network to the first flow network for selectively permitting the flow therethrough.

In another aspect, the present invention includes an improved water control system for vapor generators of the type wherein water is channeled to a vapor generator in at least two flow volumes selectively regulatable in conjunction with the operation of the vapor generator and at predefined flow rates, wherein the improvement comprises each of the flow channels including first and second flow paths coupled in parallel flow communication. The first flow path has disposed therein an adjustable flow valve for the setting of fluid flow volume therethrough. The second flow path has disposed therein a pressure responsive flow valve adapted for controlling the rate of flow therethrough in response to the pressure of fluid thereupon. In this manner, perturbations in fluid flow pressure are compensated within the second flow line for providing a generally constant fluid flow rate from the system.

In yet another aspect, the invention includes an improved method of controlling the flow of water to a vapor generator of the type wherein a first flow volume is regulated for a first vapor generation operation and a second greater flow volume is utilized for a second vapor generator operation. The water flow regulation is provided through a flow network incorporating adjustable flow valves for preselect flow. The improvement comprises the provision of first and second flow networks to the vapor generator, each in parallel flow relationship. Each flow network includes an adjustable flow control valve in a first path of the flow network. There is also provided a pressure responsive valve in the second flow path of the flow networks. The control valves of the first flow paths of the flow networks are set for the requisite flow volumes of the dual operational flow and perturbations regulated in fluid flow pressure within the flow paths with the pressure responsive flow valves.

In another aspect of the present invention there is shown a system for regulating fluid flow to a vapor generator for preselect, multi-phase operation thereof. The system comprises at least two flow networks adapted for providing the flow of fluid to the vapor generator in preselect flow volumes. Each of the flow networks comprises first and second flow conduits disposed in parallel flow relationship for simultaneously carrying fluid flow therethrough and to the vapor generator. There is also provided an adjustable flow valve disposed within the first flow conduit for permitting the setting of a preselect flow volume and a pressure responsive flow valve disposed within the second flow conduit for varying fluid flow therethrough in response to pressure perturbations within the fluid flow path of a magnitude for maintaining the fluid flow from the flow network relatively constant.

In yet another aspect of the present invention the fluid flow network is comprised of a supply water feed network, the vapor generator being set for dual flow operation. The system further includes a valve disposed between the first and second flow networks for selectively permitting the flow through the second flow network in response to high volume operation of the vapor generator and the valve between the first and second flow networks comprises a remotely actuatable valve. The pressure responsive valve comprises a first fixed orifice and a second flexible orifice contiguous thereto adapted for flexing in response to fluid flow pressure flowing thereagainst.

A further aspect of the present invention includes an improved water control system for vapor generators of the type wherein water is channeled to a vapor generator in at least two flow volumes selectively regulatable in conjunction with the operation of the vapor generator and at predefined flow rates for establishing a select vapor generator discharge temperature. The improvement comprises each of the flow channels including first and second flow paths coupled in parallel flow communication. The first flow path has disposed therein an adjustable flow valve for setting the fluid flow volume therethrough. The second flow path has disposed therein a pressure responsive flow valve adapted for controlling the rate of flow therethrough in response to the pressure fluid thereupon. In this manner perturbations in fluid flow pressure are compensated with the second flow line for providing a generally constant fluid flow rate from the system. Moreover, a second parallel flow path system comprising both an adjustable flow valve and a pressure responsive flow valve is provided in a generally parallel flow relationship. Flow through the first and second adjustable flow control valves is controlled by a remotely actuatable flow valve disposed upstream thereof and actuatable in response to the temperature condition of the discharge of the vapor generator.

BRIEF DESCRIPTION OF THE DRAWINGS

For a more complete understanding of the present invention and for further objects and advantages thereof, reference may now be had to the following description taken in conjunction with the accompanying drawings in which.

DETAILED DESCRIPTION

Figure 1:
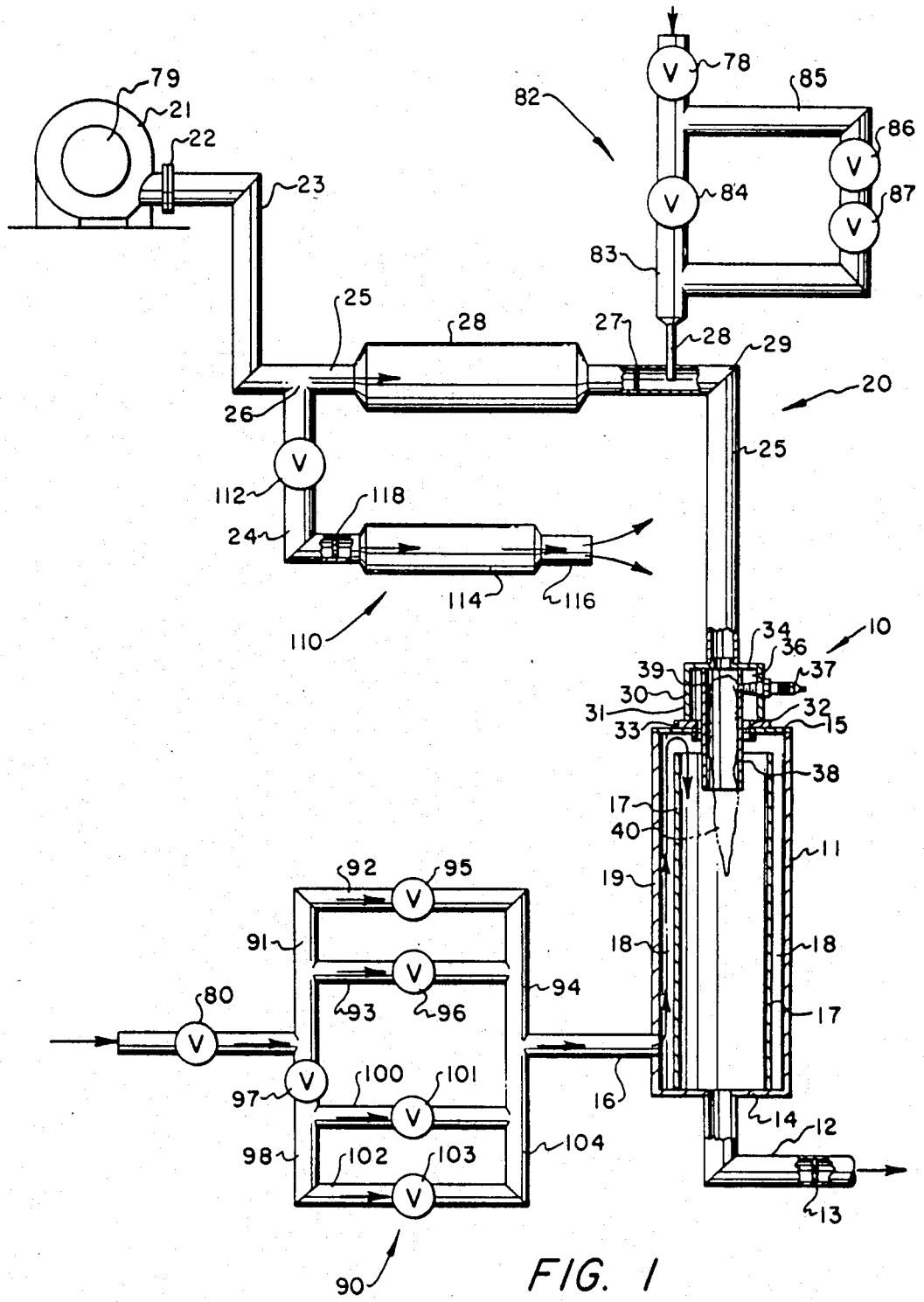
FIG. 1 is a diagrammatic illustration of a vapor generator and flow system constructed in accordance with the principles of the present invention.

Referring first to FIG. 1, there is shown a dual output vapor generator system 10 constructed in accordance with the principles of the present invention. The primary component of the system 10 is the vaporizer proper, or main combustion chamber 11. Chamber 11 is preferably an upright, closed ended, elongated cylinder adapted to enclose the bulk of the flame generated in accordance with the invention. To the lower end of chamber 11 is connected a product exit line, or conduit 12, in which is mounted a back pressure control valve 13 or the like, which is shown quite diagrammatically. As will be defined below, the vaporizer 11 operates in conjunction with a dual input flow network of air, fuel and water to provide a carefully regulated dual output system.

Still referring to FIG. 1, the chamber 11 comprises a cylindrical outer wall 19 and closed ends 14 and 15. Provision is made for the delivery of feed water to the interior of the main combustion chamber. These provisions include water inlet lines 16, and internal cylindrical wall or tube 17. Tube 17 is attached to the bottom end 14 and terminates in a relatively small distance short of the top end 15. An annular space 18 is thus established between the walls 19 and 17 extending over substantially the full height of the chamber 11. It is to be understood that the vaporizer 11 is set forth and described herein for purposes of illustration and other embodiments of vaporizer units may be utilized in accordance with the principles of the present invention for dual output vapor generation.

In operation of the select vaporizer 11, feed water is delivered into the annular space 18 through the inlet line 16. The water cools the unit and is warmed as it rises through the annular space, or jacket 18. The water then spills over the top edge of the tube 17, and flows down its inner wall. As will be explained more fully here below, during the first part of the downward travel, the water absorbs heat conductively from a shielded portion of the flame. During the final part of its downward flow, the feed water is in direct radiative and convective contact with part of the flame, and is vaporized thereby to form steam and becomes part of the product stream leaving chamber 11 via conduit 12.

The fuel and air delivery system of the invention is designated generally as 20. It includes an air compressor 21, having an air filter 22, both of which are shown diagrammatically. Various types of compressors having suitable output pressure and delivery rates may be employed. Such compressors are, however, generally comprised of relatively large motors and blowers as necessitated for conventional commercial applications. Motors of the forty horsepower variety are not uncommon in commercial applications of vapor generation units, and one aspect of the present invention is the consideration of such motor and blower units and the operation thereof.

The compressed air issuing from the compressor 21 enters conduit 23 on its way to vaporizer chamber 11. In accordance with the principles of the present invention, as more fully set forth in copending application Ser. No. 554,780, the compressed air flowing through conduit 23 may be vented through a second conduit 24. This aspect controls the volume of air permitted to ingress the vaporizer chamber 11. The venting control mode of the invention permits the compressor 21 to operate at a uniform speed although the output of the system 10 may be switched from a high to a low level. This flow rate change may also be effected without the conventional adverse effects of alteration of air flow rates.

Conventional techniques for altering the flow of air to the vaporizer chamber 11 includes the provision of a two-speed compressor motor and/or throttling devices for controlling either the input or output of compressed air. As stated above, numerous disadvantages are associated with such systems due to the fact that heat dissipation is a primary consideration in high powered conventional compressors. The invention overcomes this operational limitation by permitting the system 10 to operate without the deleterious effects of throttling systems and/or the complex and expensive multi-speed motor networks.

The compressed air stream in conduit 23 of the invention may be divided into two streams at juncture 26. The primary stream continues on through conduit 25 into a silencing unit 28 which functions much like a muffler to reduce the noise level issuing from the system 20. Downstream of the silencer 28, an orifice plate, or valve 27 may be provided for purposes of pressure regulation and mixing with the fuel input network. A secondary orifice plate and valve assembly (not shown) may also be incorporated where necessary for the dual operation modes, although it has been found effective to operate with the single orifice configuration shown herein.

Immediately downstream of orifice plate 27 in the main air flow and mixing conduit 25, there is provided a fuel inlet 28. Flow in conduit 25 just downstream of the orifice plate 27 is quite turbulent, and it is desirable to introduce the fuel at that point to initiate thorough and intimate mixing of the fuel and air. Furthermore, it is preferred that mixing conduit 25 be fairly long in order to provide a full opportunity for thorough mixing of the air and fuel stream before it reaches the combustion chamber 11. Mixing is also enhanced by the directional change in the main flow conduit 25 at the bend or elbow 29. The diameter of the mixing conduit 25 is selected in view of the desired maximum flow rate so that the lineal velocity of mixture flowing therethrough is substantially equal to or slightly greater than, the flame propagation speed. In this manner the flame established and maintained in the combustion chamber will not migrate back up into the conduit 25 or its bend 29. For example, with the designed fuel flow of 17 cubic feet per minute, mixed with a stoichiometric quantity of air, a nominal conduit diameter of about two inches has been shown to be satisfactory.

The structure and operation of the combustion chamber 11 is shown diagrammatically herein and may be modified for various applications. The specific embodiment of the combustion chamber 11 of the present invention as depicted in FIG. 1 includes a pre-combustion chamber 30 of the type set forth in U.S. Pat. No.

4,228,978 assigned to the assignee of the present invention. A branch or auxillary air conduit of the type shown in the aforesaid patent is not presented herein for purposes of clarity and may or may not be utilized in conjunction with the present invention. What is shown is a structure comprising a cylindrical housing 31, somewhat larger in diameter than opening 32 in the upper end 15 of chamber 11. Housing 31 is attached to upper end 15 by means of flange 33. The upper end of housing 31 is closed by plate 34 and a flame enclosing skirt or shield 39 depends downwardly therefrom. A cylindrical annular space 36 is thus defined by a skirt 39 and housing 31. Conduit 25 is attached to the top of the pre-combustion chamber to deliver a fuel-air mixture into the cylindrical space within shield 39.

In the present embodiment of the vaporizing combustion chamber 11, a second flame enclosing shield or skirt 38 is mounted on top end 15 to depend downwardly from opening 32. Upwardly therefrom, and extending through cylindrical shield 39, is spark plug 37 for igniting the fuel-air mixture and creating the combustion flame 40. A pilot flame as shown in the aforementioned references may also be used in lieu of said plug. With the foregoing detailed description of one embodiment of apparatus of the present invention in hand, an outline of its mode of operation can be given with reference to that description. The system 10 of FIG. 1 illustrates a dual output vapor generator system which will automatically operate at either a high and low flow rate. As can be seen from the foregoing discussion, three primary input streams are involved: fuel gas, combustion supporting gas (preferably air from an electrically driven blower or compressor), and water. There are thus three primary points of control: fuel valve 78, air compressor motor 79 (and particularly its on/off mechanism), and the main water valve solenoid 80. During start up, the spark plug 37 is also actuated to produce a pilot spark as an additional point of control.

Addressing now the fuel flow system 82, there is shown a parallel flow network upstream of the fuel inlet jet 28. The system 82 comprises a main fuel flow conduit 83 regulated by needle valve 84 and a by-pass conduit 85 through which the flow is controlled by solenoid valve 86 and needle valve 87. Fuel is permitted to flow through system 82 after actuation of the solenoid valve 78. With solenoid valve 86 in the closed position, all fuel flow extends through needle valve 84 to flow jet 28. Needle valve 84 is set for the low output operation of the system 10. When high output is demanded, solenoid valve 86 is opened to allow concurrent flow through by-pass channel or conduit 85 controlled by needle valve 87 whereby the fuel flow is increased a preselected amount. The present invention addresses the flow control of water input stream as set forth below.

Still referring to FIG. 1, water flow system 90 comprises a main flow conduit including main flow line 91 which is divided into control flow line 92 and adjustable flow line 93 coupled into feed line 94 and connected to water input line 16. Control line 92 includes a select pressure responsive valve 95. The pressure responsive valve comprises a flow control valve having a flexible orifice or the like that varies its area inversely with the pressure so that a constant flow rate is maintained for fluids passing therethrough. A variety of such pressure responsive devices are taught in the prior art and one such device is available from Dole Energy Controls. The flow control valve of this variety includes a first orifice of rigid construction disposed contiguous a second flexible orifice, the flexing of which under pressure reduces the orifice size. In this manner variations in pressure are manifest in changes in orifice dimension affording a variation in the size of the fluid flow path. This permits a constant flow of fluid through the flow control valve for variations in pressure within a preselect range.

Figure 2:
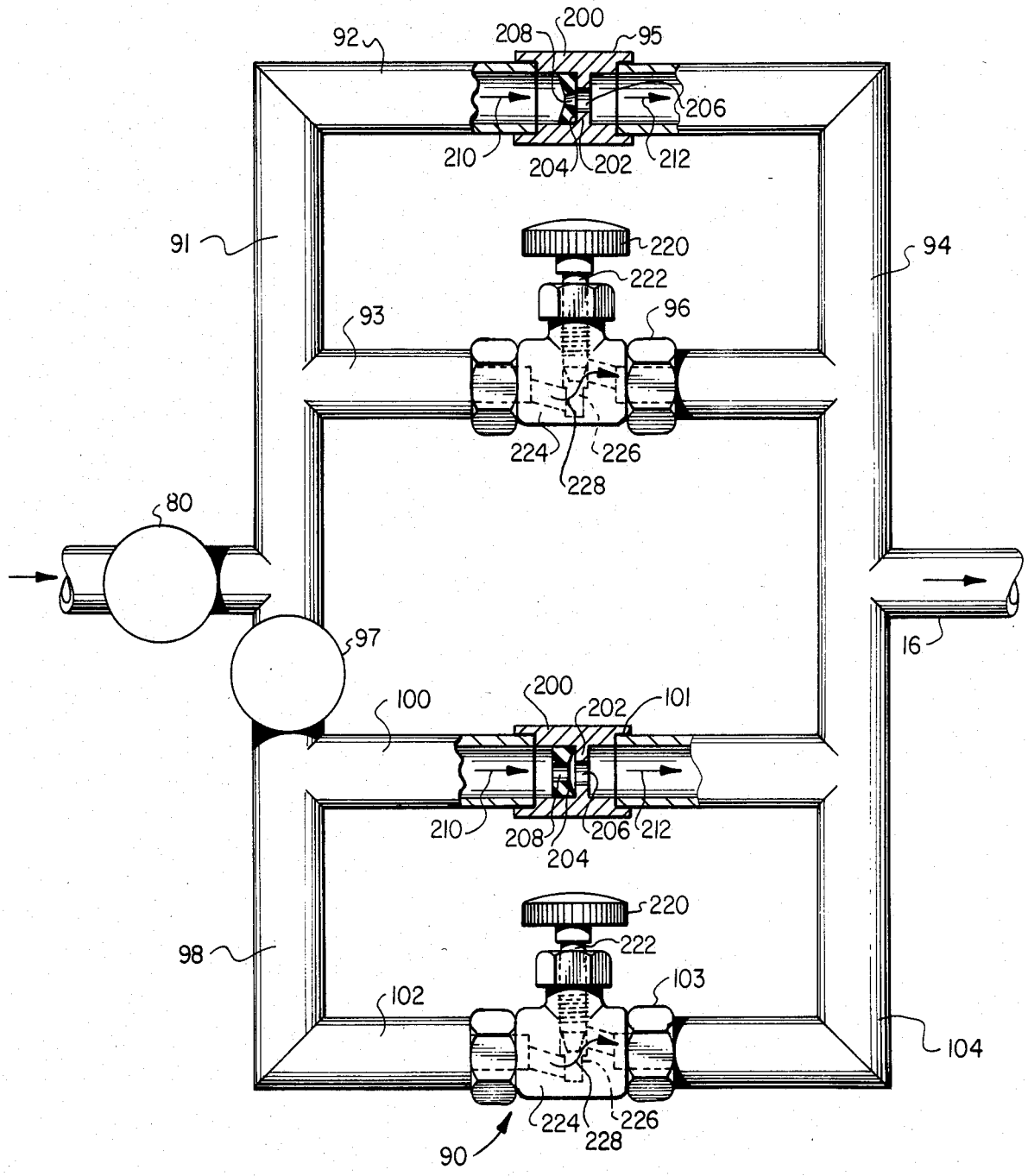
FIG. 2 is an enlarged diagrammatic illustration of the dual, pressure sensitive fluid flow system of FIG. 1 illustrating the operation thereof.

Referring now to FIG. 2, there is shown an enlarged diagrammatical view of the water flow control network of FIG. 1. Adjustment line 93 incorporates the adjustable valve 96 for permitting precise regulation of flow therethrough in conjunction with flow through line 92. A remotely actuatable solenoid valve 97 is likewise provided in a parallel flow network 98 for selectively permitting flow therethrough. Flow network 98 is provided for permitting parallel flow patterns when valve 97 is open in a similar fashion to that through primary flow conduit 91. A first control flow path 100 is thus provided with a pressure responsive valve 101 with an adjustable flow conduit 102 controlled by adjustable valve 103. Flow lines 100 and 102 combine in secondary output line 104 and merge with flow from conduit 94 to pass through input line 16.

Still referring to FIG. 2, the water flow network of this particular embodiment comprises a system 90 diagrammatically shown as 4 flow paths comprised of conduits 92, 93, 100 and 102. Flow issuing from feedline 91 into conduit 92 is vectored through pressure response valve 95. The response valve 95 as shown in the present embodiment is comprised of a housing 200 having a fixed orifice 202 formed therein. Adjacent fixed orifice 202 is a flexible orifice 204 which is responsive to the flow pressure of fluid passing therethrough. The fixed orifice 202 further defines an aperture 206 and flexible orifice 204 defines a variable aperture 208. Apertures 208 and 206 are aligned and the flow therethrough varies relative to the pressure exerted against flexible member 204. Flow 210 engaging flexible member 204 is therefore adjusted whereby resultant flow 212 remains substantially constant.

The utilization of fluid flow, pressure responsive valves is not, in and of itself, novel as discussed above. However, in the present invention the adjustable pressure responsive flow control valves are disposed in parallel flow communication with adjustable valves 96 and 103. Addressing valve 96, the adjustable valve of the present invention as depicted incorporates a needle valve comprising a handle 220 and stem 222 actuatable by rotation within a needle valve housing 224. A needle valve stem 226 seated therein adjusts the flow of fluid 228 therethrough as is desirable for the particular flow application. It may be seen that valves 96 and 101 are constructed substantially identically for permitting manual regulation of flow therethrough. In accordance with the principles of the present invention, this fluid flow regulation is preselected in accordance with the operation or characteristics of the vapor generator and the flow parameters of fuel and air which are likewise regulated for a dual flow configuration. Because water is the substance being vaporized, the precise regulation in a dual flow capacity is most critical. The feasibility of dual flow, adjustable, pressure responsive regulation over a multi-phase operation is a significant benefit and advantage over prior art systems. In the present embodiment, water flowing through the flow control network as set forth above is precisely controlled and adjustable although supply pressure may vary. Variations in supply pressure should be noted as being a significant contribution to vapor generation operation of the dual level or multi-phase level variety. The addition or deletion of substantial volumes of fluid flow will by definition increase and/or decrease any other fluid flow emanating from a single supply source. Such fluid flow perturbations are readily ascertainable in conventional plumbing systems both commercial and residential. However, in a commercial application of a vapor generator, such perturbations are critical to the performance characteristics and thus the value of the present invention should be readily recognizable.

Figure 3:
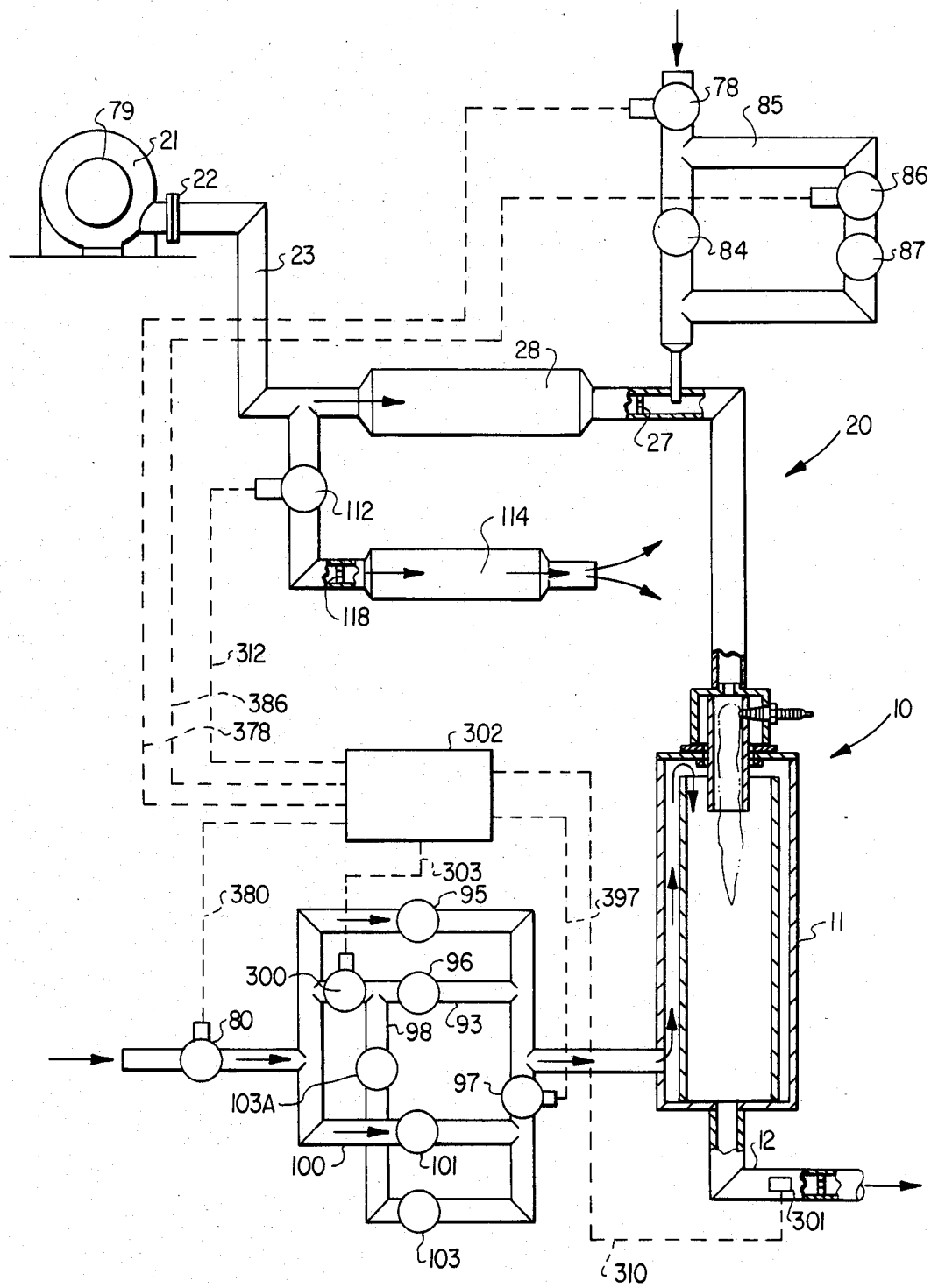
FIG. 3 is an alternative embodiment of a diagrammatic illustration of the dual, pressure sensitive, fluid flow system of FIG. 1 illustrating one system of automatic temperature control.

It may thus be seen from the aforesaid description of water flow system 90 that for low volume output of the vapor generator system 10, by-pass valve 97 remains closed to permit a single controlled flow volume through channel 91. For high output of the system 10, valve 97 is opened to permit parallel flow through the above-described by-pass system adjusted for matching the fuel-air flow volumes and combustion achieved thereby for high level output. Referring now to FIG. 3 there is shown an alternative embodiment of the vapor generator system 10 of the present invention wherein an automatic temperature control is provided as well as a modified flow circuit. As described herein, each of the solenoid valves above described in detail relative to FIGS. 1 and 2 are shown to be constructed as a solenoid valve operable by a central control unit. The automatic temperature control is achieved by the utilization of a third solenoid actuated water flow valve 300 disposed upstream of the two flow lines 93 and 98 leading to the needle valves 96 and 103. In this manner, the central control unit can actuate flow through said needle valves as necessary to increase water flow and control output temperature. The needle valve flow line 98 is therefore shown shifted relative to the main flow line 100 depicted in FIG. 2. This particular flow and valve configuration allows the dual flow control of the needle valves 96 and 103 by a single solenoid flow valve 300. The control unit 302 is coupled to the flow valve 300 by a control line 303. Likewise central control unit 302 is coupled to solenoid flow control valve 80 by control line 380. Solenoid flow valves 78 and 86 are coupled to control unit 302 by control lines 378 and 386, respectively. Likewise, air dump silencer valve 112 is coupled to the central control unit 302 by control line 312. Flow valve 97 is disposed downstream of the pressure responsive valve 101 and needle valve 103 as compared to the upstream positioning of FIGS. 1 and 2. In this position solenoid actuated flow valve 97 may be used more effectively due to the flow configuration of needle valve line 98. Solenoid flow control valve 97 is coupled to control unit 302 by control line 397. In this manner each of the flow control valves adapted for actuation for dual flow operation of the system 10 may be actuated simultaneously by a central control unit as well as the appropriate temperature control out of the vapor generator. A sensor 301 is thus provided in the discharge conduit 12 of the vapor generator 11 and coupled to the central control unit 302 by sensor line 310. In this manner control unit 302 may monitor the temperature of the discharge mixture of steam and non-condensible gases and automatically regulate the flow of water through the respective needle valves 96 and 103.

In operation, pressure responsive valve 95 is sized to permit just less than sufficient flow for low fire operation. Needle valve 96 is set to permit flow in conjunction with pressure responsive valve 95 with slightly more water than is desired for low fire operation. In this manner solenoid actuated valve 300 allows water to flow through needle valve 96 only as needed to maintain a discharge temperature as measured by sensor 301 within a preselect range. Solenoid valve 97 is open for high fire operation as is fuel flow valve 86. Dump silencer valve 112 is likewise shut for high volume operation. This permits fuel flow through both branches of the fuel flow circuit as well as water flow through both branches of the water flow circuit. Valve 96 is thus left with its previous setting with pressure responsive valve 101 sized such that with valves 95, 96 and 101 open there is not quite enough water to hold the desired steam exhaust temperature. Valve 103 is then adjusted to supply more water than is required by said valves to hold the desired steam exhaust temperature in the high fire configuration. A check valve 103A leads to valve 103 to permit flow in only one direction. The control unit 302 cycles solenoid valve 300 based on the temperature readings at sensor 301. The effect is a saw tooth temperature profile produced with a cycling temperature within a predesigned range. The solenoid flow control valve 300 therefore kicks in during both high and low flow operation to permit control of the discharge temperature by utilizing preselect ranges in the needle valves 96 and 103. The utilization of pressure responsive valves 95 and 101 in this configuration likewise permit uniformity and a preselected flow range and the advantages heretofore set forth in the application.

Referring now to the oxidant, or air flow system designated generally as 110, the main air flow conduit 25 is joined to by-pass conduit 24 at juncture 26. A remotely actuatable solenoid valve 112 is provided in line 24 for selective actuation. Air flowing through valve 112 and through conduit 24 will be vented through dump silencer 114 and exhausted through conduit 116 in the manner deemed most preferable for the specific application. An orifice 118 is likewise provided for imparting select back pressure to the flow in conjunction with orifice 27 in the main flow line 25 for select flow division with flow valve 112 in the open mode. In this manner, a select volume of air issuing from compressor or blower 21 will be diverted through the dump silencer 114 and vented rather than being permitted to pass into the combustion chamber 11. For low volume output of the generator system 10, the valve 112 is placed in the open position. In this manner, the motor 79 is permitted to operate at a uniform speed and with uniform heat dissipation irrespective of the output mode of the generator system 10.

In operation, low output is thus achieved by actuating solenod valve 112 into the open position with the compressor or blower 21 operational. The main water solenoid valve 80 is opened to permit flow with the pressure responsive valve 95 open and the adjustable, or needle valve 96 fine tuned to the specific low fire operation. Secondary water flow is prohibited by closure of secondary water solenoid 97. The pressure responsive valve 101 in by-pass network 98 may remain open with adjustable valve, or needle, valve 103 remained fine tuned for high fire operation in that flow therethrough is not occurring. The fuel flow is likewise actuated through main line valve 78 in the open position, and by-pass solenoid 86 in the closed position. The adjustable or needle valves 84 and 87 both remained tuned to their respective flow positions.

In the high volume output of the generator system 10, the solenoid valve 112 is actuated to the closed position, water flow control by-pass valve 97 actuated to the open position and fuel by-pass control valve 86 actuated into the open position. All other settings remain the same as described above and no further adjustment is necessary. In this operational mode, the entire output from the compressor or blower 21 is channeled through the primary silencer 28 into the combustion chamber 11 in conjunction with the dual water and fuel flows described above. It is believed that the operation and construction of the invention will be apparent from the foregoing description. While the apparatus thereof shown and described has been characterized as being preferred, it will be obvious that various changes and modifications may be made therein without departing from the spirit and scope of the invention as defined in the following claims.

What is claimed is:

1. A dual output, pressure responsive, adjustable, fluid flow control system comprising:

first and second flow networks coupled in parallel flow communication;

said first and second flow networks each comprising first and second flow paths;

said first flow path of said flow networks each comprising an adjustable flow control valve for regulating the flow therethrough;

said second flow path of said networks comprising a pressure responsive valve disposed therein for maintaining substantially constant flow therethrough with variations in fluid flow pressure therein;

means for supplying fluid to said flow networks;

means for receiving fluid from said fluid flow networks; and means for engaging and disengaging said second flow network to said fluid supply means for selectively permitting the flow therethrough and facilitating a dual flow output.

2. The fluid control system as set forth in claim 1 wherein said pressure responsive valve comprises a first fixed orifice and a second flexible orifice contiguous thereto adapted for flexing in response to fluid flow pressure flowing thereagainst.

3. The fluid flow control system as set forth in claim 1 wherein said adjustable flow control valves comprise needle valves adapted for permitting a select magnitude of flow therethrough for a select pressure of said fluid.

4. The fluid flow control system as set forth in claim 1 wherein said means for supplying fluid to said flow networks comprises a flow conduit connected therebetween and a remotely actuatable flow control valve for permitting the flow therethrough.

5. The fluid flow control system as set forth in claim 1 wherein said means for engaging and disengaging said second flow network to said fluid supply means comprises a flow conduit coupling said first and second flow networks and a flow valve disposed therein adapted for selectively permitting the flow therethrough.

6. The fluid flow control system as set forth in claim 5 wherein said flow control valve is remotely actuatable in conjunction with the selection of flow volume from said system.

7. The fluid flow control system as set forth in claim 1 wherein said control system is adapted for the flow of water therethrough and further including means for coupling to a vapor generator for supplying select volumes of water thereto in a dual output pressure responsive manner facilitating the efficient operation thereof.

8. The fluid flow control system as set forth in claim further including a control unit for control of said fluid supply means and control of said means for engaging and disengaging said second flow network to said fluid supply means for selectively permitting flow therethrough.

9. The fluid flow control system as set forth in claim wherein said means for engaging and disengaging said second flow network comprises a flow conduit between said first and second flow networks and a remotely actuatable valve disposed therein, said valve being coupled to said control unit for the remote actuation thereof.

* * * * *

UNITED STATES PATENT AND TRADEMARK OFFICE

CERTIFICATE OF CORRECTION

PATENT NO. : 4,544,967

DATED : October 1, 1985

INVENTOR(S) : Kenneth Louth

It is certified that error appears in the above-identified patent and that said Letters Patent is hereby corrected as shown below:

Column 25, line 49, "smaller that" should read --smaller than--;
Column 1, line 12, "CAPABILITY, No." should read --CAPABILITY Serial No.--;
Column 1, line 22, "364,352" should read --364,652--;
Column 2, line 8, "et al. No." should read --et al. Serial No.--;
Column 2, line 55, "RP" should read --RF--;
Column 5, line 7, "microprocesor" should read --microprocessor-
Column 6, line 6, " wound off on one" should read --would off of one--;
Column 6, line 24, "in the mode" should read --in that mode--;
Column 6, line 38, "scanner/tachometer occurs" should read --scanner/tachometer pulse occurs--;
Column 6, line 50, " stock registers" should read --stack registers--;
Column 7, lline 10, " 50 through 57" should read --SO through S7;
Column 7, line 64, "ramp cracking error" should read --ramp tracking error--;
Column 8, line 60, "precedingg" should read --preceding--;
Column 9, line 50, "normal" should read --nominal--;
Column 9, line 65, "case, when" should read --case, then--;
Column 10, line 47, "eitht" should read --eight--;
Column 12, line 37, "bandwith" should read --bandwidth--;
Column 13, line 54, "comprehehsively" should read --comprehensively--;
Column 13, line 56, "transducing head relative to" should read --transducing head to be properly aligned with--;
Column 14, line 45, "distributed therealong" should read --distributed differently therealong--;

UNITED STATES PATENT AND TRADEMARK OFFICE

CERTIFICATE OF CORRECTION

PATENT NO. : 4,544,967

DATED : October 1, 1985

INVENTOR(S) : Kenneth Louth

It is certified that error appears in the above-identified patent and that said Letters Patent is hereby corrected as shown below:

Column 15, line 5, "FIG. 12(7)" should read --FIG. 6(7)--;
Column 15, line 66, "very" should read --vary--;
Column 17, line 22, "Up/-" should read --Up/--;
Column 17, line 31, "up/-" should read --up/--;
Column 17, line 63, "FIGS. 7 and llaand llb" should read --FIGS. lla and llb--;
Column 18, line 16, "up/-" should read --up/--;
Column 18, line 17, "apropriately" should read --appropriately--;
Column 20, line 15, " shown in FIG. 15" should read --shown in FIG. 15(4)--;
Column 20, line 18, "FIG. 25(4)" should read --FIG. 15(4)--;
Column 23, line 46, "up/-" should read --up/--;
Column 23, line 47, "counter 912" should read --counter 962--;
Column 24, line 4, "horizonta" should read --horizontal--

Signed and Sealed this

*Fifteenth* Day of *April 1986*

[SEAL]

*Attest:*

DONALD J. QUIGG

*Attesting Officer*

*Commissioner of Patents and Trademarks*